US006726209B2

(12) United States Patent
Kim

(10) Patent No.: US 6,726,209 B2
(45) Date of Patent: Apr. 27, 2004

(54) DARTBOARD ROTATING APPARATUS

(76) Inventor: Yong Cheol Kim, 101-617 Ho seong weon Apt, 783, Shinnae-Dong, Chunnang-Gu, Seoul (KR)

( * ) Notice: Subject to any disclaimer, the term of this patent is extended or adjusted under 35 U.S.C. 154(b) by 0 days.

(21) Appl. No.: 10/176,612

(22) Filed: Jun. 24, 2002

(65) Prior Publication Data

US 2003/0038427 A1 Feb. 27, 2003

(30) Foreign Application Priority Data

Aug. 25, 2001 (KR) ..... 20-2001-26175

(51) Int. Cl.[7] ..... F41J 3/00
(52) U.S. Cl. ..... 273/408; 273/407; 273/404
(58) Field of Search ..... 473/371–377, 473/403, 404, 407, 408

(56) References Cited

U.S. PATENT DOCUMENTS 2,179,471 A * 11/1939 Lee ..... 273/368
3,756,599 A * 9/1973 Imatt et al. ..... 273/387
4,850,598 A * 7/1989 LaTulippe ..... 273/408
5,118,116 A * 6/1992 Cherni ..... 273/408
5,573,250 A 11/1996 Kuo ..... 273/408
6,073,931 A * 6/2000 Voden ..... 273/404

FOREIGN PATENT DOCUMENTS

WO WO 91/15729 * 10/1991

* cited by examiner

*Primary Examiner*—Mark S. Graham
(74) *Attorney, Agent, or Firm*—St. Onge Steward Johnston & Reens LLC

(57) ABSTRACT

The present invention relates to a dart board assembly which makes a front dart board positioned on a rear board rotate smoothly while preventing separation due to the vibration from rotation of the front dart board. The front dart board includes a flat panel; a central shaft rearwardly protruding at the center of the flat panel, an inner stepped portion stepped at the inner diameter of the central shaft to a predetermined depth, and an engaging recess formed at the center of the central shaft for engaging a screw spike. A connection shaft is formed with a plurality of stepped portions including a proximal stepped portion inserted into the inner stepped portion of the central shaft, an intermediate portion supported by the inner diameter portion of the rear board, a distal stepped portion stepped and coupled to the inner diameter portion of a ball bearing, and a through hole formed at the center so that the screw spike can be passed through.

6 Claims, 2 Drawing Sheets

DARTBOARD ROTATING APPARATUS

BACKGROUND OF THE INVENTION

1. Field of the Invention

The present invention relates to a dart board assembly, and more particularly, to a dart board assembly which makes a front dart board positioned on a rear board rotate smoothly while making them not separate due to the vibration occurring at the rotation of the front dart board.

2. Description of the Related Art

Generally, as illustrated in FIG. 1, a rotary dart board includes a rear board 1, and a front dart board 2 having a longitudinal shaft 3 extending rearward from the back of the front board 2. The longitudinal shaft 3 is inserted within the central opening of a ball bearing 10 which is securely contained in a circumferential recess 4 extending forward from the rear board 1. The longitudinal shaft 3 of the front dart board 2 is directly connected to the ball bearing 10 via a washer 7 and a screw spike 6 inserted into an engaging recess 9 formed at the back of the central axis of the shaft 3. This structure is problematic in that the screw spike 6 engaged to the engaging recess 9 is easily loosened by the vibration occurring at the rotation of the front dart board 2, and thus the front dart board 2 is separated from the rear dart board 1, or the vibration phenomenon becomes more critical.

In addition, as illustrated in the drawing figure, since the height of the central shaft 3 is larger than that of the circumferential projection of the front dart board 2, it is not easy to load and store the front dart board 2 in a disassembled state prior to assembly and production.

SUMMARY OF THE INVENTION

It is, therefore, one object of the present invention to provide a dart board assembly which can restrict separation of a front dart board from a rear board and the occurrence of vibration during the rotation of the front dart board. The front dart board may rotate smoothly and can be easily loaded and stored in a disassembled state.

To achieve the above and other objectives, there is provided a dart board assembly, comprising: a rear board including a first panel, said panel defining an opening at an intermediate location of the first panel, the rear board further including a cylindrical projection extending rearward from a rear surface of the first panel, the cylindrical projection formed coaxially with the intermediate opening and defining an inner opening; a bearing positioned within the inner opening of the cylindrical projection of the rear board; a front board including a second panel, the front board further including a longitudinal projection extending rearward from a rear surface of the second panel, the longitudinal projection defining a bore formed along the longitudinal axis of the longitudinal projection at a distal end thereof, the longitudinal projection further defining a screw hole longitudinally extending through the bore of the longitudinal projection; a connection shaft including a proximal end portion configured to detachably insert within the bore of the longitudinal projection of the front board, an intermediate portion having a diameter configured to fit within the opening of the first panel of the rear board, and a distal end portion configured to fit within a central opening of the bearing, the connection shaft defining a hole longitudinally extending there-through; and a screw inserted through the longitudinal hole of the connection shaft and into the screw hole of the longitudinal projection of the front board for connecting the connection shaft and the front board.

The dart board assembly of the invention preferably includes a washer introduced between the head portion of the screw and the distal end portion of the connection shaft. The dart board assembly of the invention also preferably includes a peripheral projection extending rearward from the front board. In addition, the height of the longitudinal projection of the front board is preferably smaller than that of the peripheral projection 31 formed at the periphery of the front dart board.

BRIEF DESCRIPTION OF THE DRAWINGS

The above objects, features and advantages of the present invention will become more apparent from the following detailed description which are described hereafter in conjunction with the accompanying drawings, in which.

DETAILED DESCRIPTION OF THE DRAWINGS

A preferred embodiment of the present invention will now be described with reference to the accompanying drawings.

Figure 1:
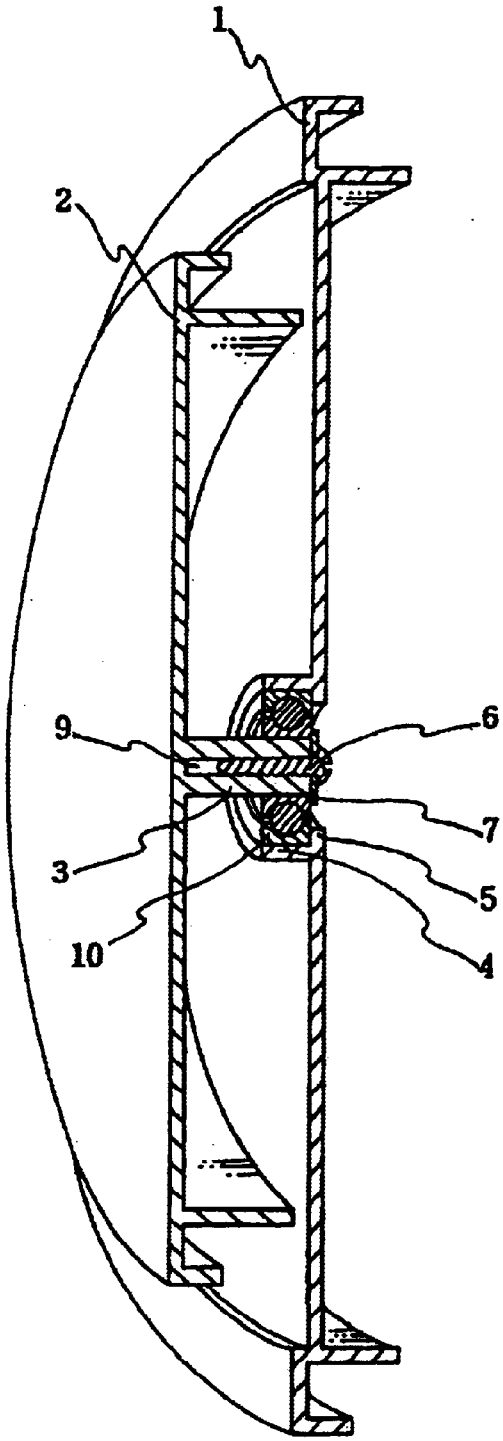
FIG. 1 (PRIOR ART)
FIG. 1 is a side cross-sectional view illustrating a conventional dart board rotating apparatus.
Figure 2:
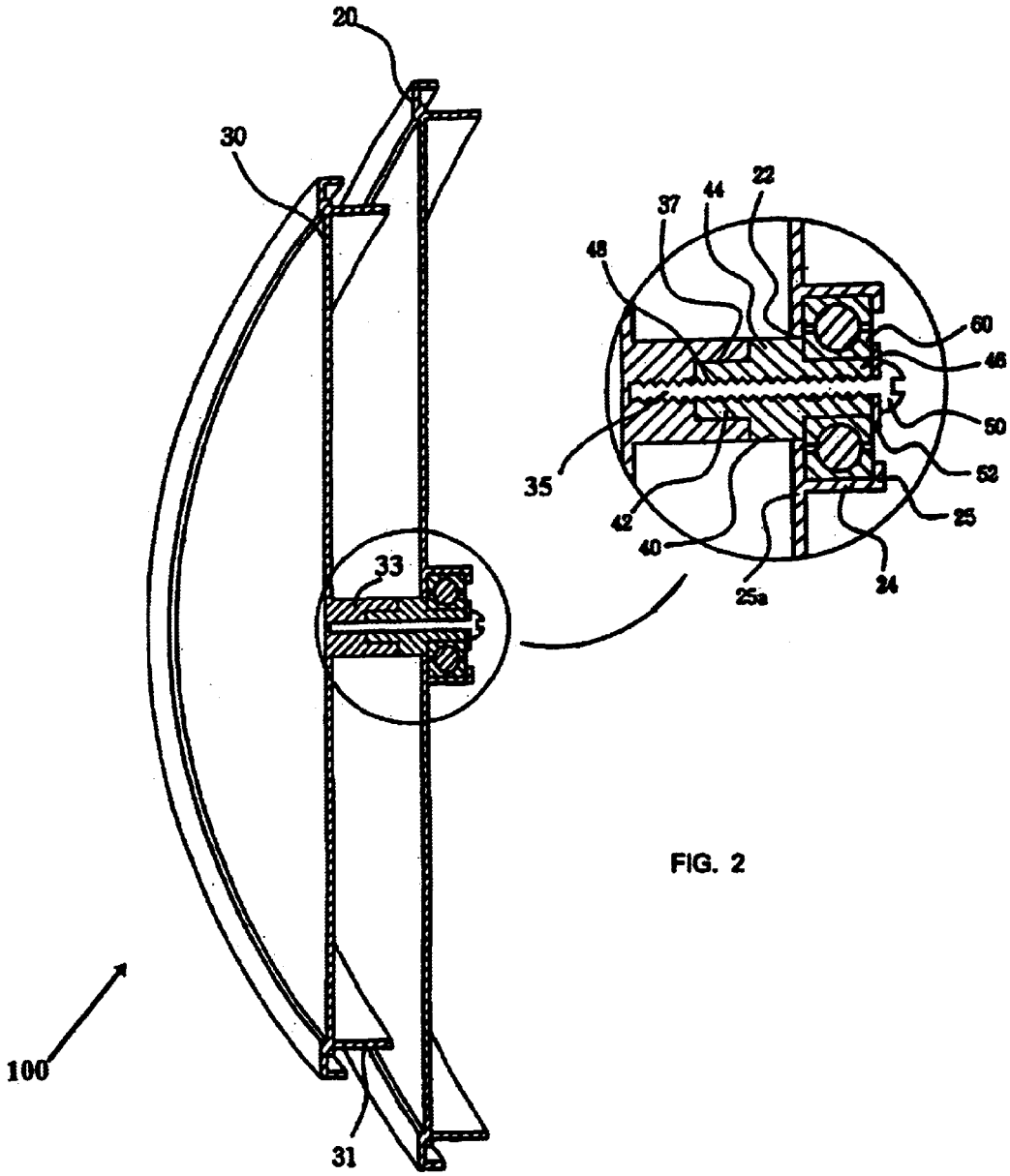
FIG. 2 is a side cross-sectional view illustrating a dart board rotating apparatus in accordance with the present invention.

FIG. 2 is a side cross-sectional view illustrating a dart board assembly in accordance with the present invention. Reference numeral 100 represents a dart board assembly of the invention. The dart board assembly 100 includes a rear board 20 performing a supporting operation in contact with a wall if it is hung on the wall by a user; a front dart board 30 rotatably coupled to the front of the rear board 20 and created with various designs for a dart game; a supportable connection shaft 40 formed at the center of the rear board 20 and front dart board 30 while connecting them both rotatably, a ball or roller bearing 60 disposed at one end of the lateral side of the connection shaft 40 and rotates the front dart board 30; and a screw spike 50 is supportably engaged by a washer 52 so that the connection shaft 40 and the bearing 60 cannot be pulled out.

The rear board 20 includes an inner diameter portion 22 formed to pass through the center of the rear board 20; a circumferential recess 24 formed at the back of the rear board 20 for mounting the ball bearing 60 thereto; and latch jaws 25 and 25*a* supporting the bearing 60 so that it cannot be pulled out. That is to say, in a case that the bearing 60 is inserted into the circumferential recess 24 and is pushed by a predetermined external force, since the outer diameter of the bearing 60 is larger than the inner diameter of the latch jaws 25 and 25*a* by 1–3 mm, the bearing is inserted into the circumferential recess 24 while pushing the latch jaws 25 and 25*a* and thereafter it is not pulled out naturally.

In addition, the front dart board 30 includes a peripheral projection 31 protruding at the periphery of the back of the front dart board 30 for bearing an external force; a central shaft 33 protruding at the center of the front dart board 30 to conform to the center of the circumferential recess 24; an inner stepped portion 37 stepped at the inner diameter of the central shaft 33 to a predetermined depth; and an engaging recess 35 formed at the center of the central shaft 33 for engaging the screw spike 50.

Since the height of the central shaft 33 of the front dart board 30 is smaller than that of the peripheral projection 31, the front dart board 30 can be managed efficiently in manufacturing, storing and delivery, thereby reducing cost.

In addition, the connection shaft 40 is connected between the rear board 20 and the front dart board 30 for acting as a medium formed with a plurality of stepped portions. The connection shaft 40 includes a proximal stepped portion 42 inserted into the inner stepped portion 37 of the central shaft 33; a projection supporting intermediate portion 44 supported by the inner diameter portion 22 of the rear board 20; a distal stepped portion 46 stepped and coupled to the inner diameter portion of the bearing 60; and a through hole 48 formed at the center so that the screw spike can be passed through.

The connection shaft 40 of the above-described embodiment is only provided for the convenience of description. Thus, the present invention is not limited to this embodiment. For example, the length of the proximal stepped portion 42, projection supporting intermediate portion 44 and distal stepped portion 46 can be adjusted according to the state of use.

Such a dart board assembly, as illustrated in FIG. 2, can not only be applied to a rotary front dart board consisting of a rear board 20 and front dart board 30 of a round shape, but it can also be applied to a rotary front dart board consisting of a rear board 20 with the front dart board 30 in a square, rectangular or ellipse shape.

As described above, in the dart board assembly of the invention, since the connection shaft serves as a bushing in case the ball bearing contained in the circumferential recess of the center of the rear board constituting the rotary dart board of the present invention is connected with the central shaft by the connection shaft for rotation, the rear board is smoothly rotated to prevent the front dart board from being separated from the rear board or prevent vibration. In addition, the dart board assembly can be used semi-permanently and it can improve the distribution, storability and productivity since the height of the central shaft is smaller than that of the peripheral projection of the front dart board.

What is claimed is:

1. A dart board assembly comprising:

a rear board including a first panel, said panel defining an opening at an intermediate location of the first panel, the rear board further including a cylindrical projection extending rearward from a rear surface of the first panel, the cylindrical projection formed coaxially with the intermediate opening and defining an inner opening;

a bearing positioned within the inner opening of the cylindrical projection of the rear board;

a front board including a second panel, the front board further including a longitudinal projection extending rearward from a rear surface of the second panel, the longitudinal projection defining a bore formed along the longitudinal axis of the longitudinal projection at a distal end thereof, the longitudinal projection further defining a screw hole longitudinally extending through the bore of the longitudinal projection;

a connection shaft including a proximal end portion configured to detachably insert within the bore of the longitudinal projection of the front board, an intermediate portion having a diameter configured to fit within the opening of the first panel of the rear board, and a distal end portion configured to fit within a central opening of the bearing, the connection shaft defining a hole longitudinally extending there-through; and a screw inserted through the longitudinal hole of the connection shaft and into the screw hole of the longitudinal projection of the front board for connecting the connection shaft and the front board.

2. The dart board assembly of claim 1 further including a washer introduced between a head portion of the screw and the distal end portion of the connection shaft.

3. The dart board assembly of claim 1, wherein the front board further including a peripheral projection extending rearward from the front board.

4. The dart board assembly of claim 3, wherein the height of the longitudinal projection of the front board is shorter than the height of the peripheral projection of the front board.

5. The dart board assembly of claim 1, wherein the rear board has a generally rectangular shape.

6. The dart board assembly of claim 1, wherein the hole of the connection shaft is a screw hole.

* * * * *